United States Patent [19]

Freese

[11] 4,151,887

[45] May 1, 1979

[54] CUSHION DOZER WITH HIGH PIVOT MOUNTING

[75] Inventor: Gary P. Freese, Joliet, Ill.

[73] Assignee: Caterpillar Tractor Co., Peoria, Ill.

[21] Appl. No.: 806,809

[22] Filed: Jun. 15, 1977

[51] Int. Cl.[2] ..... E02F 3/76

[52] U.S. Cl. ..... 172/809; 414/722; 180/69.1

[58] Field of Search ..... 172/801, 803, 804, 805, 172/806, 807, 808, 809; 214/131 R, 130 R, 140; 180/69.1

[56] References Cited

U.S. PATENT DOCUMENTS

| | | | |
|---|---|---|---|
| 2,404,760 | 7/1946 | Washbond | 172/801 |
| 3,158,944 | 12/1964 | Rehberg | 172/803 |
| 3,238,647 | 3/1966 | Hall | 172/801 |
| 3,487,884 | 1/1970 | Volberding | 172/803 |
| 3,521,713 | 7/1970 | Spanjer | 172/809 X |
| 3,727,699 | 4/1973 | Baker | 172/809 |
| 3,809,167 | 5/1974 | Glider | 172/801 |
| 3,826,327 | 7/1974 | Stover | 180/69.1 |
| 3,844,369 | 10/1974 | Schroeder | 172/801 |

*Primary Examiner*—Richard J. Johnson

*Attorney, Agent, or Firm*—Wegner, Stellman, McCord, Wiles & Wood

[57] ABSTRACT

A tractor is provided with a main frame, a blade, and a C-frame which has a pair of substantially parallel spaced apart legs joined together at one end portion thereof, each leg of the C-frame has a curved portion extending upwardly and away from said leg. Each curved portion of the C-frame is pivotally mounted to the main frame of the tractor. The C-frame is operatively connected to said blade whereby forces engaging said blade are transmitted through the C-frame directly to the main frame of the tractor.

11 Claims, 5 Drawing Figures

CUSHION DOZER WITH HIGH PIVOT MOUNTING

BACKGROUND OF THE INVENTION

1. Field of the Invention

This invention relates to bulldozer blades and, more particularly, to an improved frame assembly for mounting a push blade to a tractor.

2. Description of the Prior Art

Tractors having a cushioned push blade have been used for many years, for instance, to push earthmoving scrapers, and the like, during loading of the scraper. Although the cushioned push blade mounted on a tractor has been useful, there are occasional breakdowns that cause downtime of the equipment for repairs. Some of the known cushioned push blades are mounted to the tractor by links connected to the lower corners of the blade and extending upwardly and rearwardly therefrom to connect with the lower front corners of the tractor frame with the cushioning element extending from the upper portion of the blade upwardly and rearwardly to connect with the tractor frame above and rearward of the links. The resulting structure, when used, transmits forces from the scraper to the tractor in a way as to reduce effective traction for the pushing operation.

Other known structures used a C-frame which was connected to the lower corners of the blade with the ends of the legs of the C-frame extending straight back and being pivotally connected to downwardly depending trunnions carried by plates bolted or welded to the undersurface of the frame of the tractor. Cushioning members were connected to the C-frame and to the upper portion of the blade with the lines of force through the cushioning elements intersecting the tractor frame above the bottom frame of the tractor. The tractor frame was weakened by the welding or drilling of the holes for the bolts for securing the plates to the frame. The weakening of the frame reduced main frame life by increasing the stresses in the frame. The weight of the plates added undesirable weight to the bottom rails of the frame and the use of bolts to secure the plates required added service to be sure the nuts had not loosened or that the bolts had not sheared. The plates interfered with ready access to the bottom of the tractor such that it was necessary to remove the plates to gain access to the underside of the tractor.

SUMMARY OF THE INVENTION

The present invention is directed to overcoming one or more of the problems as set forth above.

According to the present invention, a cushioned push blade mounting to a tractor is provided and includes a C-frame pivotally mounted to the lower portion of the blade with a portion of the legs and crossbeam of the C-frame lying in a plane. The rear portion of each leg is curved upwardly from the plane of the C-frame and is pivotally attached directly to the side rails of the tractor frame by a clevis-type mounting with the axes of the pins of the clevis-type mountings being aligned with each other. Cushioning members are carried by the C-frame and are pivotally connected by pins to the upper portion of the blade. The axes of the pin connections of the C-frame to the side rails of the frame are in a plane containing the neutral horizontal axes of the side rails of the tractor frame. The stress in the tractor frame is reduced not only due to the location of the connection of the C-frame to the side rails, but also due to the elimination of the bolt holes and/or welding of the C-frame support plate to the side rails. Mounted in this way, the resultant forces pass through the axes of the pins connecting the C-frame to the tractor frame.

The improved assembly eliminates the mounting plates thereby reducing the weight on the side rails of the tractor frame. The mounting to the frame eliminates the need for either welding or drilling and bolting the plate to the frame thereby adding to the life span of the frame. The C-frame is easier to install on the tractor frame and provides easy access for removal of the belly guard and/or crankcase guard whereby access to the under parts of the tractor is readily gained.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
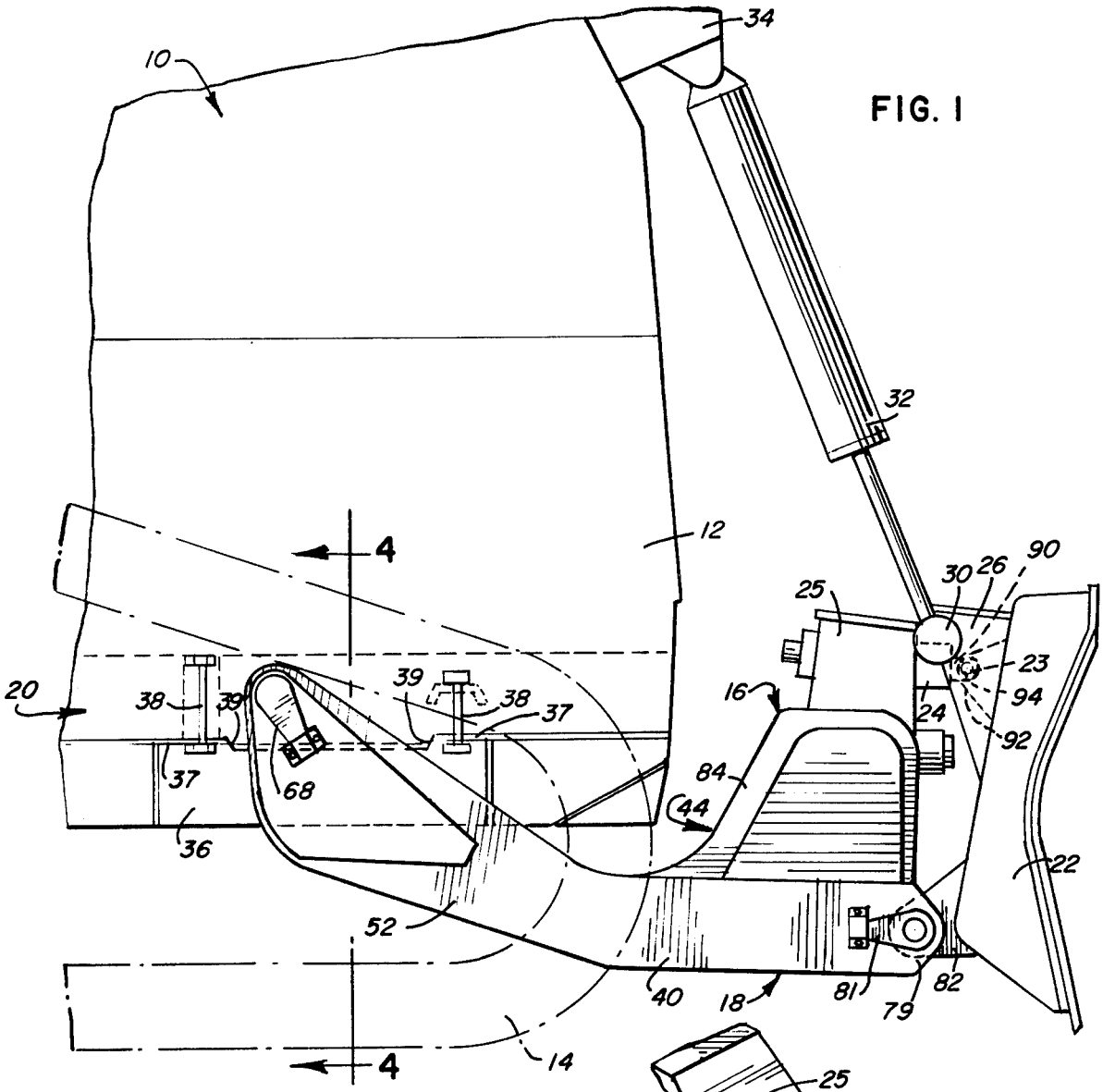
FIG. 1 is a broken away, front corner, elevational view of a tractor with a bulldozer push blade and push blade assembly thereon.

Referring to the drawings wherein like reference numerals refer to like parts throughout, a tractor 10 has a front lower portion shown at 12 with a pair of tracks 14, one of which is shown in phantom in its normal relative position with respect thereto. A cushioned pushblade assembly 16 is comprised of a C-shaped frame 18 pivotally connected to the frame 20 of the tractor 10 at one end portion thereof, with the other end portion being pivotally connected to the lower portion of a push blade 22. Cushioning members 24 are mounted on towers 25 on the C-frame 18 and are pivotally connected at 23 to the upper portion of the push blade 22. A support bracket 26 is permanently affixed to the upper rear portion of the push blade 22 and has sidewardly supported joints 30 to which a pair of lift cylinders 32 are operatively connected. The upper portion of the lift cylinders 32 are connected to the tractor 10 through brackets 34 on the upper portion of the main frame 20. As shown partially in phantom in FIG. 1 and in cross section in FIG. 4, a belly guard 36 is removably secured by bolts 38 to the side rails of the frame of the tractor 10 and, in its normal position, is held against the side rails of the frame to cover a portion of the bottom of the tractor. The attaching flanges 37 of the belly guard 36 are cut out at each side at 39 to permit the C-frame 18 to pass therethrough as will be described in more detail hereinafter. The belly guard 36 can be unbolted, dropped down and canted to permit the flanges 37 to clear the C-frame 18 to remove said guard from the frame so as to gain access to the crankcase and to other operative parts of the engine and drive train of the tractor 10.

Figure 2:
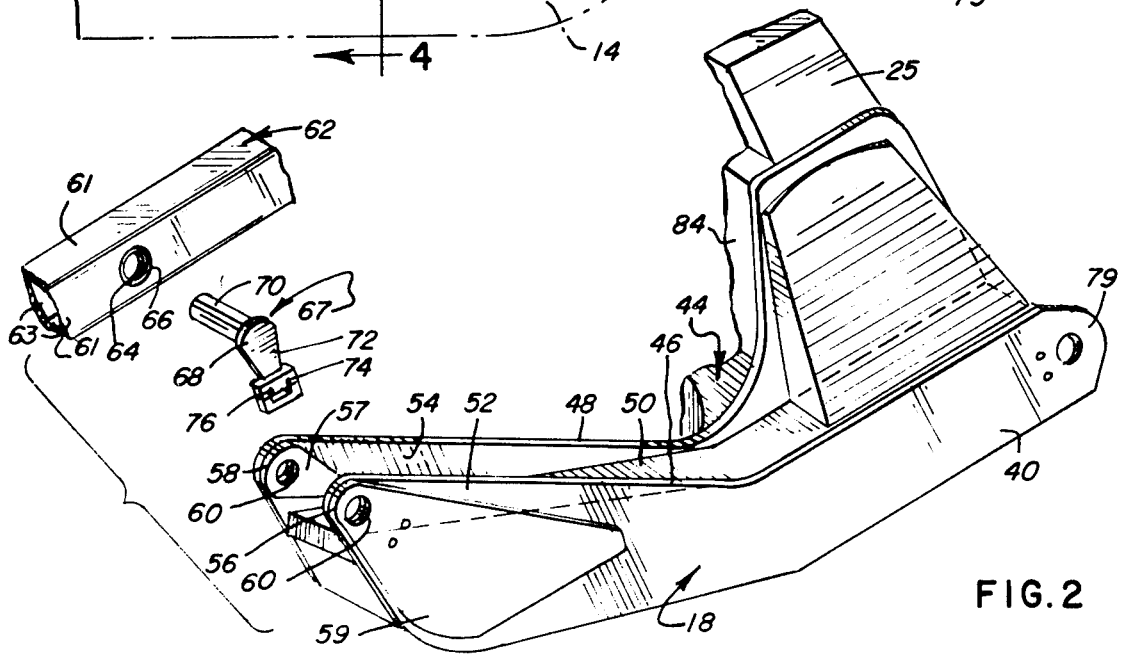
FIG. 2 is a partial perspective view of one leg of the C-frame with the clevis pin and side rail of the tractor frame exploded therefrom.

The C-frame 18 of the push-blade assembly 16 is comprised of a pair of spaced apart side legs 40 and 42 which are joined together along one end portion thereof by a tubular crossbeam 44. Each side leg 40 and 42 is comprised of a pair of spaced apart wall portions 46 and 48 which are joined together by a top wall 50 and a bottom wall 51 to form a box-like structure in cross section. The wall portions 46 and 48 of each side leg 40 and 42 have upwardly curved portions 52 and 54 which terminate at remote ends 56 and 58, respectively, through which ends are formed aligned apertures 60. Each upwardly curved portion 52 and 54 is formed by continuations of the spaced apart walls 46 and 48. The top wall 50, as shown in FIG. 2, extends across the open space between the walls 46,48 whereby the upwardly curved portions 52,54, with ends 56,58, extend freely without any support therebetween. A plate 59 is secured to each curved portion 52 and extends from the end 56 to beyond the intersection of the top wall 50 with the wall 46 of the box-shaped portion of the legs 40,42 to provide added support to the ends 56 of the walls 46. Reinforcing plates 57 are secured to the inside of the ends 58 of the curved portions 54 and extend to the intersection of the top wall 50 with the side wall 48, to add strength to the ends 58 of the walls 48. The aligned apertures 60 are formed through the plates 59,57 as well as through the ends 56,58.

Figures 3, 4, 5:
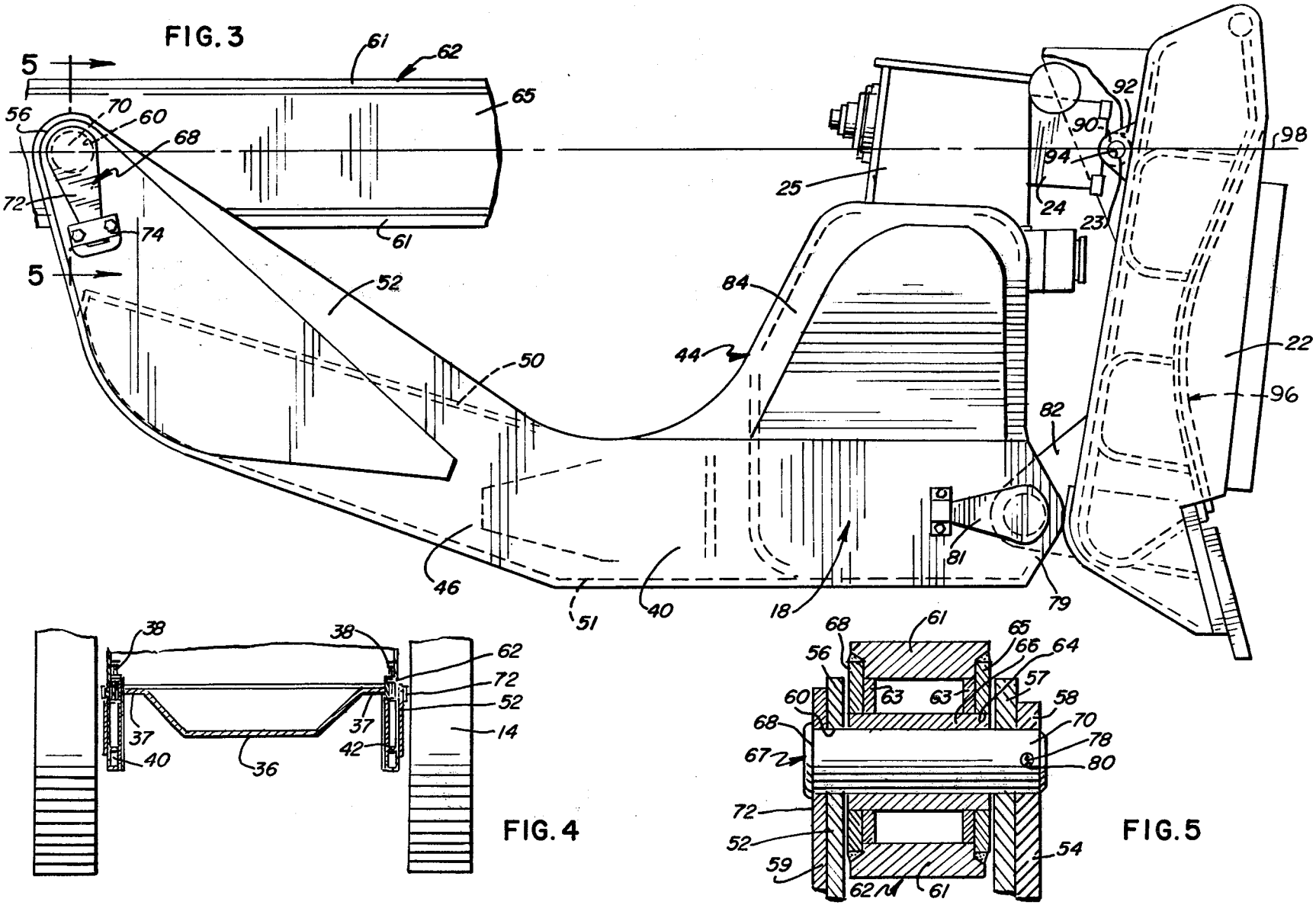
FIG. 3 is an enlarged elevational view of the push blade assembly showing details of the invention.
FIG. 4 is a cross-sectional view taken along the line 4—4 of FIG. 1.
FIG. 5 is a partial cross-sectional view taken along the line 5—5 of FIG. 3.

The C-frame 18 is attached to the tractor frame 20 by means of the ends 56,58 of the upwardly curved portions 52 and 54 of the legs 40 and 42 straddling the side rails 62 of said tractor frame 20. As shown in FIGS. 2 and 5, the side rails 62 of the tractor frame 20 are comprised of top and bottom cross members 61 joined by plates 63 and side walls 65. The walls 63,65 of the side rails 62 are apertured at 64 through which a bearing sleeve 66 extends. Clevis-type mountings or fasteners 67 are provided for pivotally securing said legs 40, 42 of the C-frame 18 to the side rails 62 of the frame of the tractor 10. Specifically, the clevis-type fastener 67 is a teardrop retainer 68 which has a pin 70 with a latch plate 72 integrally attached thereto and extending transverse to the axis of the pin 70. The pin 70 passes through the aperture 60 in the portion 52 of the leg 40 and 42 and through the bearing sleeve 66 in the side rail 62 and through aperture 60 in the portion 54 for pivotally securing the legs 40 and 42 to the C-frame 18 to the tractor frame. With the retainer 68 in position through the opening 60 and bearing sleeve 66, the remote end of the latch plate 72 is locked to the side wall of plate 59 on the leg 42 by means of a bolted bracket 74. That is, the remote end of the plate 72 is engaged in a shaped portion of the bracket 74 with bolts 76 holding the bracket and, thus, the plate 72, to the side wall 46 of the curved portion 52 of the side leg 40. A locking pin 78 is passed through an aperture 80 in the other end portion of the pin 70 so as to positively lock the pin 70 in position.

The walls 46 and 48 of each leg 40 and 42 project forward at 79 from the crossbeam 44 to straddle the spaced apart mounting plates 82 carried by the lower rear portion of the blade 22. Fasteners or teardrop retainers 81, which are the same type as retainers 68, are used to pivotally support the legs 40 and 42 of the C-frame 18 to the mounting plate 82 so that the blade 22 is pivotable about the lower portion thereof. The tubular crossbeam 44 of the C-frame 18 has an upwardly formed mounting portion 84 extending substantially across the width of the C-frame. A pair of towers 25 are secured symmetrically to the upper surface of the portion 84.

Within each tower 25 is mounted a pair of the cushioning members 24, it being understood that one or more cushioning members 24 could be used in each tower. Cushioning members 24 can be any one of the well-known types on the market, such as those described in the Rehberg et al U.S. Pat. No. 3,158,944 issued Dec. 1, 1964 and entitled "Bulldozer With Resilient Means for Pushing Operations", which patent is owned by the common assignee of the present application. The details and operation of the cushioning members 24 will not be described in detail since the disclosure of the Rehberg et al patent is incorporated herein by reference. Each cushioning member 24 has a forwardly projecting rod 90 which is pivotally connected at 23 by a pin 94 to a pair of brackets 92 carried by the upper portion of the blade 22. The cushioning members 24 are spaced apart from each other and are mounted slightly inwardly from the plane containing the legs 40 and 42 of the C-frame 18. The connection 23 between each cushioning member 24 and the blade 22 is effected by the pins 94 which have axes substantially aligned with each other. The bracket 26 is shown in FIG. 3 with a portion of the side wall broken away so as to illustrate the connection 23 of the cushioning members 24 to the brackets 92 on the blade 22.

Any forces transmitted to the pins 94 and fasteners 81 by the blade 22 will be cushioned by the cushioning members 24 with the resultant forces passing through the C-frame 18 directly to pins 70 and thus to the side rails 62 and frame 20 of the tractor. Since the pins 70 are located on the neutral horizontal axis of the side rails 62 of the tractor frame 20, the stresses on the side rails 62 will be reduced. It should be noted that as a push load applied to the blade 22 is moved up from a point 96 toward the horizontal axis 98 of pin 70, the load on the lift cylinder 32 gets smaller, which in turn, reduces the stress on the tractor main frame. However, as said push load point moves up on the blade, the moment arm of the resultant force about the lower portion of the legs of the C-frame gets larger, thereby increasing the stress on the C-frame.

In use, when the tractor 10 is used as a pusher for an earth scraper, in order to assist in filling and moving the scraper, the blade 22 of the tractor 10 is engaged with the rear of the scraper. Because of the rough terrain and the nature of the control of a tractor, initial contact between the tractor and the scraper is generally done with some relative motion between the two vehicles so that a relatively large initial force is encountered upon contact. This force is transmitted through the blade partially to the cushioning members 24 and partially through the C-frame with the resultant force passing to the pins 70 and side rails of the tractor frame along the neutral axis of the side rails. As the tractor pushes the scraper, the surging shocks of force are absorbed, in part, by the cushioning members 24 with the forces being transmitted directly to the tractor frame through the C-frame.

Since the cushioned-blade assembly is pivotally attached directly to the tractor frame by means of clevis-type mountings using pins 70, it is not necessary to drill the frame to attach the mounting plate previously used, so that the frame is now stronger and, therefore, has increased life. The improved push-blade assembly is easier to install since it is only necessary to transversely drill one hole in each side of the side rails of the main frame for receiving the mounting bushings 66, instead of drilling a plurality of holes upwardly into the bottom of the frame, which plurality of holes had to be aligned with mating openings in the mounting bracket which takes considerably more time and, as mentioned above, weakens the frame. The clevis-type mountings of the cushioned blade assembly to the tractor frame makes it possible to mount a belly guard 36 so that ready access can be had to the lower interior of the tractor without removing the mounting brackets for the push assembly. The belly guard has cut outs 39 which permit the legs 40 and 42 to pass therethrough, not only for attachment of the legs to the side rails 62, but also to permit the legs 40, 42 to articulate about the axis of the pins 70 without interference. With the bolts 38 removed, the guard 36 can be dropped down and maneuvered about to be removed from the frame and from the C-frame without requiring disconnection of the C-frame from the side rails. With the C-frame formed as a continuous part between the connection to the blade and the mounting to the side rails of the frame of the tractor, it is cheaper to fabricate and requires less service in use. The pivot connections between the prior mounting plate and the prior C-frame is eliminated together with the problems associated therewith.

The embodiment of the invention in which an exclusive property or privilege is claimed is defined as follows:

1. A tractor having a main frame, a blade, a C-frame having a pair of substantially parallel spaced apart legs joined together at one end portion thereof, each leg having a curved portion extending upwardly and away from said leg, each leg of said C-frame is composed of a pair of spaced apart sides joined together by spaced walls, the curved portions of the spaced sides of each leg span side rails of the main frame of the tractor, means for pivotally mounting said curved portions of said legs of said C-frame to the main frame of the tractor, and means for operatively connecting said C-frame to said blade whereby forces engaging said blade are transmitted through the C-frame to the tractor frame.

2. A tractor as claimed in claim 1 wherein cushioning means are provided between said blade and said C-frame.

3. A tractor as claimed in claim 2 wherein said cushioning means is mounted between the upper portion of the blade and an upwardly extending portion of the C-frame with the connection between the cushioning means and blade substantially aligning with the connection between the C-frame and the main frame when the alignment of said connections lie substantially parallel to the longitudinal axis of the tractor.

4. A tractor as claimed in claim 1 wherein said curved portions of the C-frame have aligned apertures which are aligned with apertures in the side rails of the main frame, and said means for pivotally mounting said curved portions to the main frame comprising pivot pins passing through said apertures, a plate member secured to one end of each pivot pin, and means for securing said plate members to said curved portions so as to retain said pivot pins in position in said apertures.

5. A cushioned push assembly for a tractor having a frame, said assembly comprising a blade, a C-frame pivotally connected to the lower portion of said blade and to said tractor frame, cushioning members mounted on said C-frame and connected to the upper portion of said blade, said C-frame comprising a pair of substantially parallel spaced apart legs joined together at one end portion of each leg, each leg of said C-frame is composed of a pair of spaced apart sides joined together by spaced walls, each leg having an upwardly curved portion extending away from said leg and terminating in an apertured end portion, the curved portions of the sides of each leg span the sides of the frame of the tractor, and clevis-type mounting means have a pin extending through each said apertured end portion and through a side of the frame of said tractor for pivotally mounting said C-frame to the tractor frame.

6. A cushioned push assembly as claimed in claim 5 wherein each cushioning member is mounted in an upwardly extending tower carried by the joined together portion of said C-frame, said cushioning members being connected to the blade in alignment with the connection between the C-frame and tractor frame.

7. A cushioned push assembly as claimed in claim 5 wherein a belly guard is secured to the sides of the frame of said tractor, and fastening means are provided for releasing said belly guard for exposing the underside of said tractor without interference from said clevis-type mountings of the C-frame to the frame of the tractor.

8. A cushioned push assembly as claimed in claim 5 wherein means are provided for raising and lowering said blade relative to said tractor frame.

9. A cushioned push assembly as claimed in claim 8 wherein said means is a cylinder connected between the upper portion of the blade and the upper portion of the tractor.

10. In a tractor having a cushioned push-blade assembly comprising a blade, a frame for pivotally supporting the lower portion of said blade to said tractor, cushioning means mounted on said frame and connected to the upper portion of said blade, hydraulic means for raising and lowering said blade, in the combination said frame comprising a pair of substantially parallel spaced apart legs joined together by a crossbeam, each leg having an upwardly curved portion extending away from said leg and terminating in an apertured end portion, pin means for pivotally mounting said apertured end portions of the frame directly to side rails of said tractor whereby push forces from the blade are transmitted directly through said frame to the side rails of the tractor and each cushioning means is mounted in an upwardly extending tower carried by said crossbeam of said frame, said cushioning means connection to the blade aligning with the connection between the frame and the side rails of the tractor along an axis parallel to the longitudinal axis of the tractor.

11. A tractor as claimed in claim 10 wherein a belly guard is removably mounted to the side rails of said tractor between said connections of the frame to the side rails, and means extending between the guard and the side rails for holding said guard secured to the tractor whereby release of said means releases said guard for exposing the underside of said tractor without interference from said pivot means connecting said frame to the side rails of the tractor.

* * * * *